US007691465B2

(12) United States Patent
Bukovitz et al.

(10) Patent No.: US 7,691,465 B2
(45) Date of Patent: Apr. 6, 2010

(54) DROP CLOTH SYSTEMS AND METHODS OF USING SAME

(75) Inventors: Richard K. Bukovitz, Orrville, OH (US); John L. Scott, Sr., Wooster, OH (US); Michael L. Zimmerman, Wooster, OH (US)

(73) Assignee: The Wooster Brush Company, Wooster, OH (US)

( * ) Notice: Subject to any disclaimer, the term of this patent is extended or adjusted under 35 U.S.C. 154(b) by 110 days.

(21) Appl. No.: 11/848,530

(22) Filed: Aug. 31, 2007

(65) Prior Publication Data

US 2009/0061119 A1 Mar. 5, 2009

(51) Int. Cl.
*A47G 9/06* (2006.01)

(52) U.S. Cl. ..... 428/99; 5/417; 383/4; 428/98

(58) Field of Classification Search ..... 428/99; 383/4; 5/417

See application file for complete search history.

(56) References Cited

U.S. PATENT DOCUMENTS

| | | | | |
|---|---|---|---|---|
| 3,410,023 | A | 11/1968 | Anello | |
| 3,724,893 | A | 4/1973 | Giroux | |
| 3,862,876 | A | 1/1975 | Graves | |
| 3,872,549 | A | 3/1975 | Elyea | |
| 4,821,353 | A * | 4/1989 | Neri | 5/418 |
| 5,176,452 | A | 1/1993 | Stern | |
| 5,199,375 | A | 4/1993 | Johson | |
| 5,266,390 | A | 11/1993 | Garland | |
| 5,373,942 | A | 12/1994 | Weder | |
| 5,638,642 | A | 6/1997 | Nemec | |
| 5,761,853 | A | 6/1998 | Trosper et al. | |
| 5,816,305 | A | 10/1998 | May | |
| 5,845,804 | A | 12/1998 | Prescott | |
| 5,930,956 | A | 8/1999 | Trosper et al. | |
| 6,911,407 | B2 | 6/2005 | Sherrod et al. | |
| 2001/0055927 | A1 | 12/2001 | May | |

* cited by examiner

*Primary Examiner*—Brent T O'Hern
(74) *Attorney, Agent, or Firm*—Renner, Otto, Boisselle & Sklar, LLP

(57) ABSTRACT

Drop cloth systems include drop cloths having edge supports extending along two opposite edges of the drop cloths for preventing folding of the opposite edges along which the edge supports extend. Extending between the edge supports is at least one spring strip having the property of being substantially straight when unwound to maintain the drop cloths substantially spread out on the surface area to be protected. Also the spring strips have the property of being windable to permit the drop cloths to be rolled up from one of the opposite edges along which the edge supports extend for easy storage and transportation when not in use.

19 Claims, 4 Drawing Sheets

DROP CLOTH SYSTEMS AND METHODS OF USING SAME

FIELD OF THE INVENTION

The present invention relates to drop cloth systems for use by painters when protecting a surface area of a floor or other surface area against splatter during painting or otherwise coating some other surface such as a wall or ceiling and the like.

BACKGROUND OF THE INVENTION

Drop cloths made, for example, of fabric, plastic or canvas (hereinafter collectively "drop cloths") are commonly used to protect surface areas such as floors against splatter during painting or otherwise coating another surface such as a wall or ceiling or the like. A problem with previous known drop cloths is the time it takes to spread them out where desired for use and refold them after use. Another problem is making the drop cloths stay flat on the floor and being able to easily move them from one location to another without any soiled areas on the top surface of the drop cloths folding over and coming into contact with the floor or other surface area to be protected.

SUMMARY OF THE INVENTION

The present invention overcomes these and other problems by providing drop cloth systems that are fast and easy to position during use, and are also fast and easy to roll up for ease of storage and transportation when not in use. Moreover, the drop cloth systems of the present invention maintain the drop cloths substantially flat on the surface area to be protected without bunching up during use, and are easily moved from one location to another for fast and precise positioning without concern that any splattered areas on the drop cloths will fold over and come into contact with the floor or other surface area being protected.

In accordance with one aspect of the invention, the drop cloth systems include drop cloths having edge supports extending along two opposite edges of the drop cloth for preventing folding of the opposite edges along which the edge supports extend, and at least one spring strip extending between the edge supports, the spring strip having the property of being substantially straight when unwound to maintain the drop cloth substantially spread out on the surface area to be protected.

In accordance with another aspect of the invention, the support assemblies may be removably connected to the drop cloths to permit the support assemblies to be removed for cleaning or replacement of the drop cloths.

In accordance with another aspect of the invention, the spring strips have the property of being windable to permit the drop cloths to be rolled up from one of the opposite edges along which the edge supports extend and may be maintained rolled up using straps or ties and the like for easy storage and transportation when not in use.

In accordance with another aspect of the invention, the drop cloths may be comprised of multiple layers including a moisture-repellent bottom layer, a moisture-absorbent middle layer, and a top layer that allows moisture to pass therethrough for absorption by the middle layer.

In accordance with another aspect of the invention, two or more support assemblies may be attached to a single drop cloth with the edge supports of each support assembly extending along the same opposite edges of the drop cloths in end-to-end relation to each other with spacing between adjacent ends of the edge supports to permit the drop cloth to be folded between the edge supports with any soiled portions of the drop cloth facing each other and then rolled into a tube for easy storage and transportation when not in use.

In accordance with another aspect of the invention, one or more rolled up drop cloth systems may be placed on the surface area to be protected and released to allow the spring strips to unwind the drop cloths so the drop cloths are substantially spread out on the surface area to be protected.

In accordance with another aspect of the invention, the drop cloth systems may be moved from one location to another on the surface area to be protected while the drop cloths are maintained spread out by the edge supports and the unwound spring strips.

In accordance with another aspect of the invention, two or more of the drop cloth systems may be placed on the surface area to be protected with one of the drop cloth systems trailing another of the drop cloth systems, and the trailing drop cloth system may be moved ahead of the other drop cloth system during painting or coating along a wall or the like as the painting or coating progresses along the wall.

In accordance with another aspect of the invention, two of the drop cloth systems may be placed on top of each other with any splattered sides of the drop cloths facing each other and rolled up together into a tube and maintained rolled up using straps or ties or the like for easy storage and transportation when not in use.

These and other advantages, features and aspects of the present invention will become apparent as the following description proceeds.

To the accomplishment of the foregoing and related ends, the invention, then, comprises the features hereinafter more fully described and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF THE DRAWINGS

The present invention may be more readily understood by reference to the following drawings in which.

DETAILED DESCRIPTION OF THE INVENTION

Figure 1:
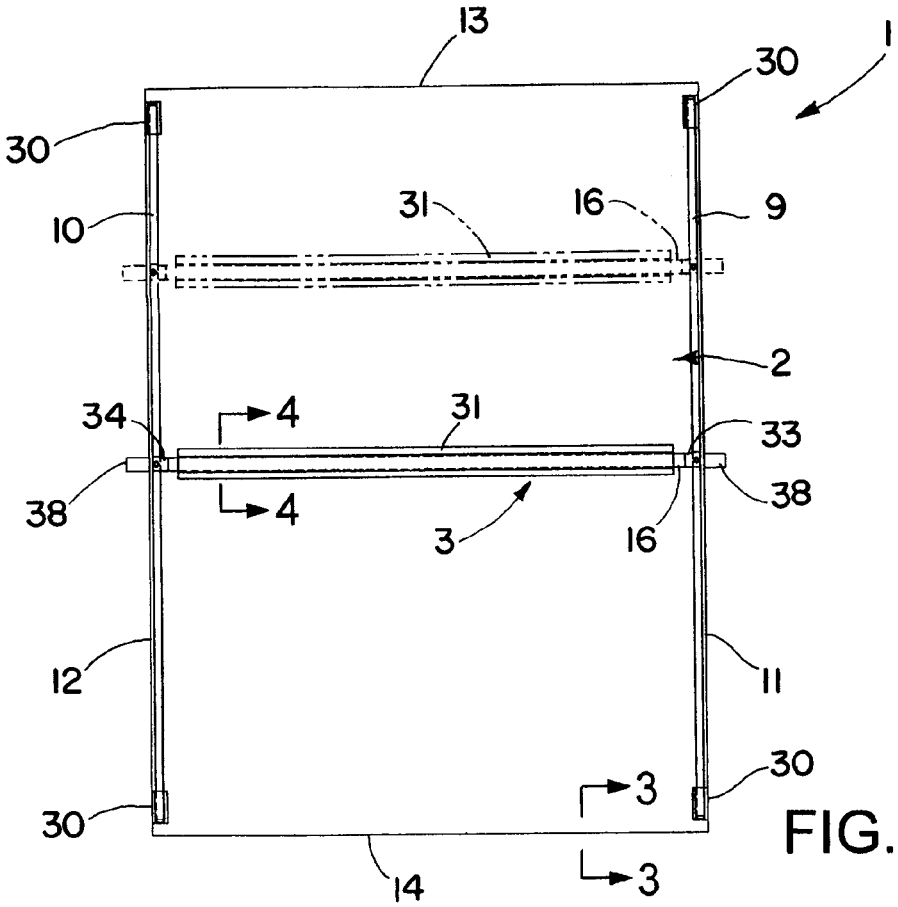
FIG. 1 is a schematic top plan view of one form of drop cloth system of the present invention.

Referring now more particularly to the drawings, wherein like reference numerals are used to designate like parts, and initially to FIG. 1, there is shown one form of drop cloth system 1 of the present invention including a drop cloth 2 and associated support assembly 3 for maintaining the drop cloth spread out as described hereafter on a surface area of a floor or other surface area to be protected against splatter during painting or otherwise coating another surface such as a wall or ceiling or the like.

Figure 3:
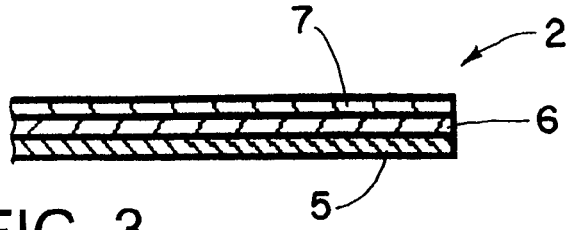
FIG. 3 is an enlarged fragmentary transverse section through the drop cloth of FIG. 1 taken generally along the plane of the line 3-3 thereof.

As shown in FIG. 3, the drop cloth 2 may be comprised of multiple layers including a moisture-repellent bottom layer 5, a moisture-absorbent middle layer 6, and a top layer 7 that allows moisture (i.e., liquid splatter) to pass therethrough for absorption by the middle layer. However, it is to be understood that the drop cloth may also be made of a single layer of a suitable coated or uncoated fabric, plastic or canvas sheet material or the like if desired.

Regardless of the material of the drop cloth 2, the support assembly 3 therefor includes rigid or stiff edge supports 9, 10 extending along two of the opposite side edges 11, 12 or end edges 13, 14 of the drop cloth for preventing folding of the opposite edges along which the edge supports 9, 10 extend. In addition, the support assembly 3 includes at least one spring strip 16 extending between the edge supports 9, 10 having the property of being unwindable and substantially straight when unwound to maintain the drop cloth substantially spread out as schematically shown in FIG. 1. Also the spring strip has the property of being windable to permit the drop cloth to be rolled up from one of the edges along which the edge supports extend and maintained rolled up for easy storage and transportation when not in use.

Figure 4:
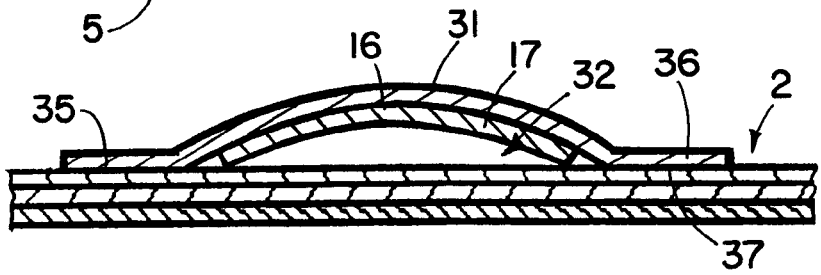
FIG. 4 is an enlarged fragmentary transverse section through the drop cloth and spring strip of the drop cloth system of FIG. 1 taken along the plane of the line 4-4 thereof.
Figure 5:
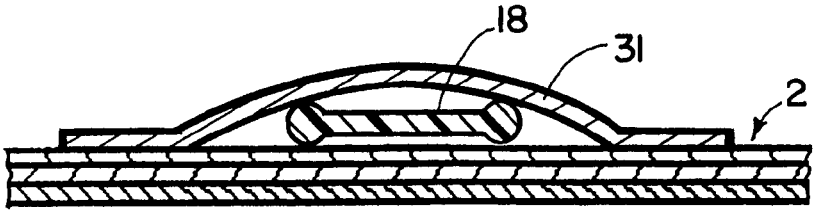
FIGS. 5-8 are enlarged fragmentary transverse sections similar to FIG. 4 but showing different spring strip configurations that may be used with the drop cloth systems of the present invention.
Figure 6:
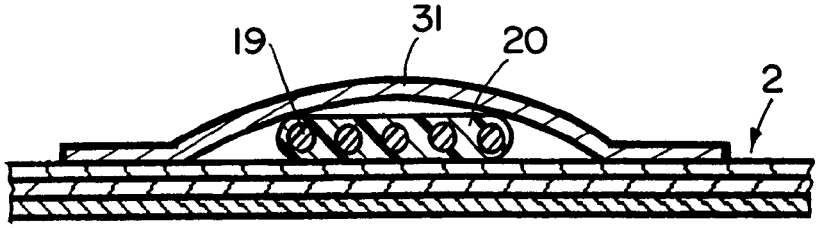
Figure 7:
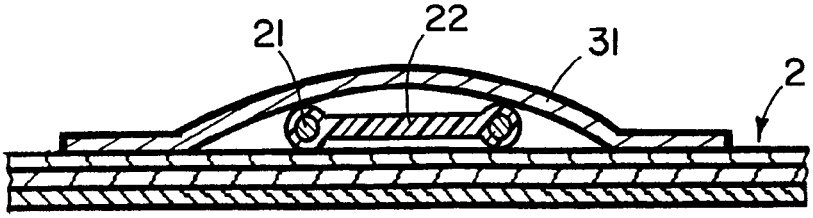
Figure 8:
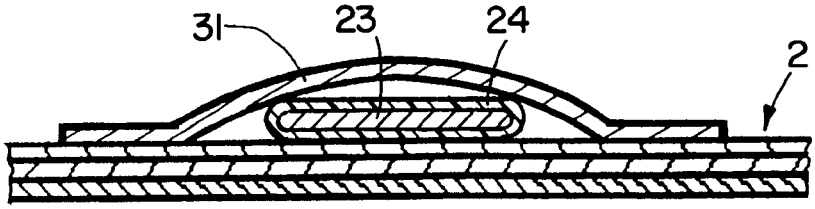

If desired, the spring strip 16 may be made of metal or plastic or a combination thereof as long as the spring strip exhibits the properties previously described. For example, the spring strip 16 may be a length of spring steel 17 having a curved cross section as shown in FIG. 4 to give the spring strip rigidity when straight. Alternatively the spring strip may be an acetal polymer strip 18 having an I-beam cross section as shown in FIG. 5, a plurality of acetal polymer wires 19 surrounded by an elastomeric polymer cover 20 as shown in FIG. 6, a plurality of spring steel or acetal wires 21 embedded in an olefin polymer 22 as shown in FIG. 7, or a spring steel or acetal ribbon 23 having an olefin polymer cover 24 as shown in FIG. 8.

Figure 2:
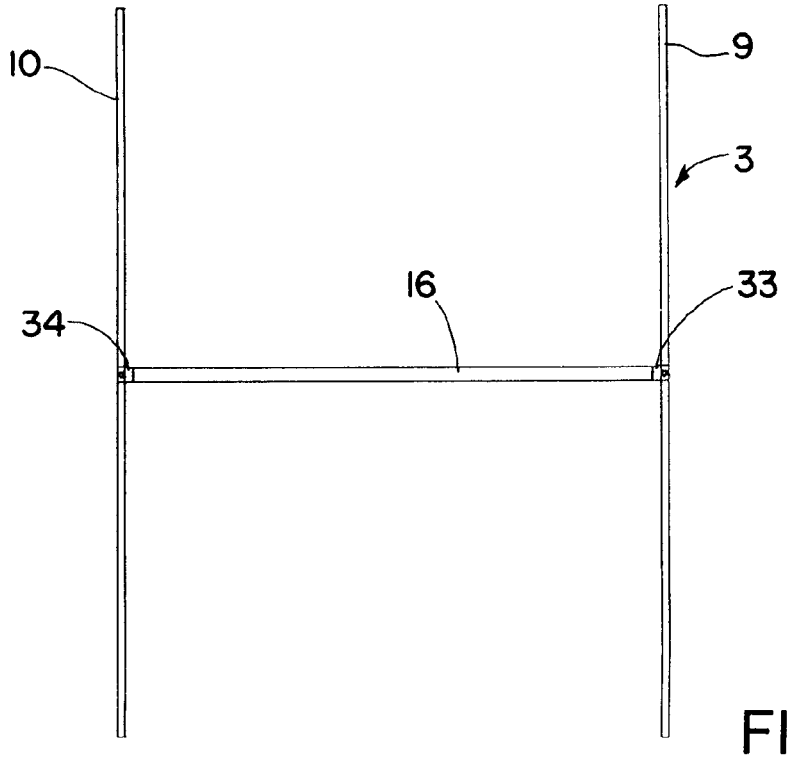
FIG. 2 is a schematic top plan view of the support assembly portion of the drop cloth system of FIG. 1.

As to the drop cloth system 1 shown in FIG. 1, the support assembly 3 is removably connected to the drop cloth 2 to permit the support assembly to be removed for cleaning or replacement of the drop cloth as needed. To that end, the opposite edges 11, 12 of the drop cloth along which the edge supports 9, 10 extend may include fabric loops or pockets 30 in which opposite ends of the edge supports may be removably received as schematically shown in FIG. 1. Also a strip 31 of material may be secured to the drop cloth in a direction extending between the opposite edges 11, 12 along which the edge supports 9, 10 extend to provide a channel 32 (see FIG. 4) in which the spring strip 16 is slidably received.

Where opposite ends 33, 34 of the spring strip 16 are fixedly attached to the edge supports 9, 10 as schematically shown in FIGS. 1 and 2, one side edge 35 of the material strip 31 that forms the channel 32 in which the spring strip is received may be permanently attached to the drop cloth and the other side edge 36 may be detachable from the drop cloth as by providing a hook and loop fastener 37 therebetween for ease of attachment and removal of the spring strip from the drop cloth.

Figure 11:
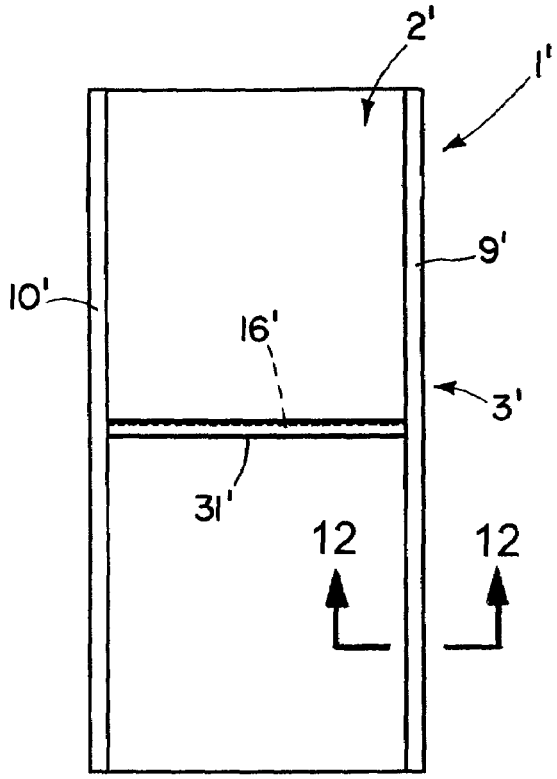
FIG. 11 is a schematic top plan view of still another form of drop cloth system of the present invention.
Figure 12:
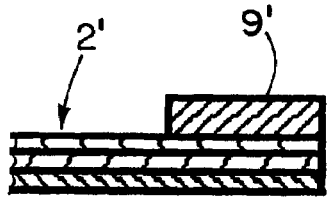
FIG. 12 is an enlarged fragmentary transverse section through one of the edge supports of the drop cloth system of FIG. 11 taken generally along the plane of the line 12-12 thereof.

Alternatively, the edge supports 9', 10' of the drop cloth system 1' may be made of a stiff material that is adhesively bonded or otherwise permanently affixed to opposite edges of the drop cloth 2' as schematically shown in FIGS. 11 and 12. In that event the ends of the spring strip 16' need not be attached to the edge supports and the spring strip may be inserted and removed from the channel formed by the material strip 31' through the opposite open ends thereof.

Figure 9:
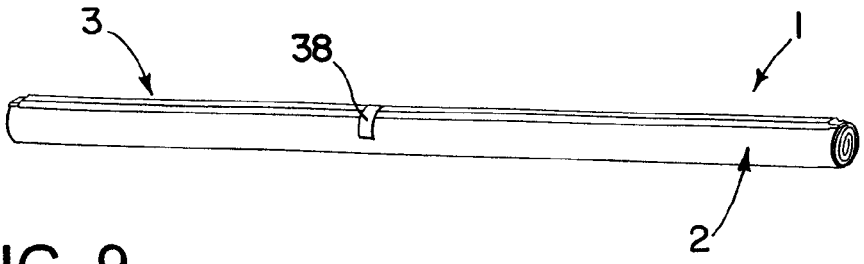
FIG. 9 is a schematic perspective view showing the drop cloth system of FIG. 1 rolled up.

Because the spring strip 16 has the property of being substantially straight when unwound, and the edge supports 9, 10 prevent folding of the opposite edges of the drop cloth 2 along which the edge supports extend, the support assembly will maintain the drop cloth substantially spread out on the surface area to be protected without bunching up. Further, the support assembly will allow the drop cloth to be easily moved from one location to another for fast and precise positioning without the possibility of the soiled top surface of the drop cloth folding over and coming into contact with the floor or other surface area being protected. Yet because the spring strip 16 also has the property of being windable, the drop cloth 2 can easily be rolled up from one of the edges along which the edge supports 9, 10 extend and maintained rolled up using straps or ties 38 or the like that may include hook-and-loop fasteners to releasably secure the straps or ties around the rolled up drop cloth for maintaining the drop cloth rolled up as shown in FIG. 9 for easy storage and transportation when not in use. To use the rolled up drop cloth is a simple matter, it only being necessary to place the drop cloth system on the surface area to be protected and release the straps or ties to allow the spring strip to unwind the drop cloth so the drop cloth is once again substantially spread out as shown in FIG. 1.

Figure 13:
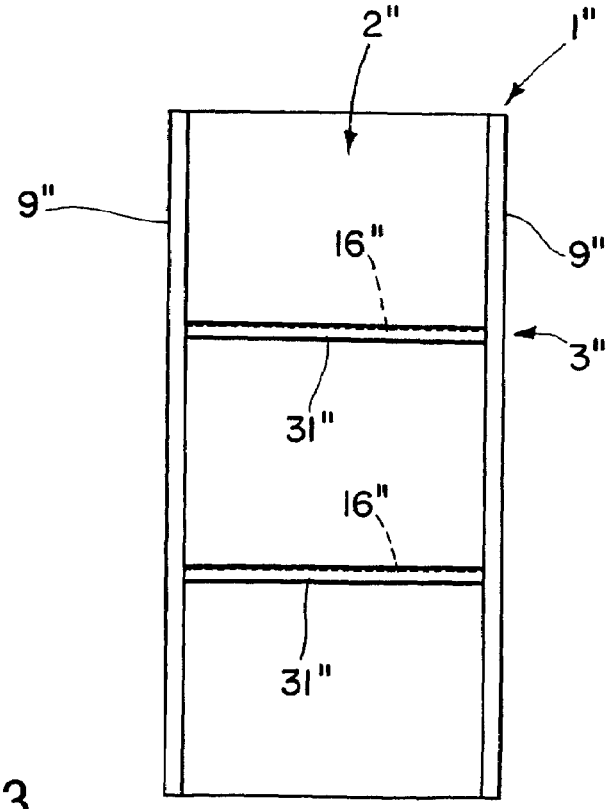
FIG. 13 is a schematic top plan view of still another form of drop cloth system of the present invention.

If a greater spring force is needed to cause the rolled up drop cloth to unwind and maintain the drop cloth spread out on the floor or other surface area being protected, two or more spring strips 16" may be provided between the edge supports 9", 10" as shown in solid lines in FIG. 13 (and also shown in phantom lines at 16 in FIG. 1). Otherwise the details of construction and operation of the drop cloth assembly 1" shown in FIG. 13 is substantially the same as the drop cloth system 1' shown in FIGS. 11 and 12, and the same reference numbers followed by a double prime symbol (") are used to designate like parts.

Figure 10:
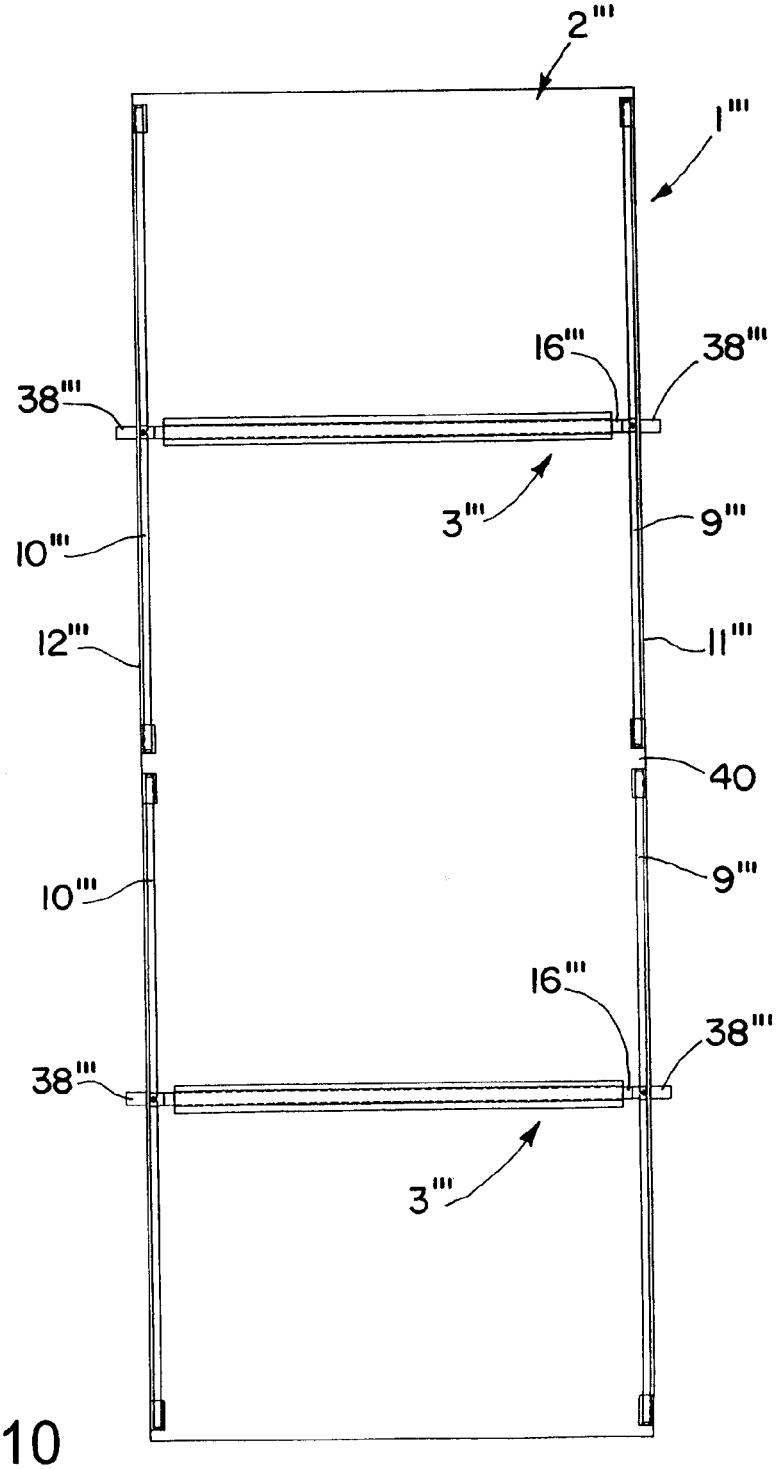
FIG. 10 is a schematic top plan view of another form of drop cloth system of the present invention.

Two such drop cloth systems 1 may conveniently be used on a job by placing one of the spread out drop cloths behind another spread out drop cloth, and moving the trailing drop cloth ahead of the other drop cloth during painting or otherwise coating a wall or the like as the painting or coating progresses along the wall. When the job is completed, one drop cloth system may be placed on top of the other drop cloth system with the soiled sides of the drop cloths facing each other and then rolled up together into a tube and maintained rolled up together using straps or ties as before for easy storage and transportation when not in use.

Where there is a need for a longer or wider drop cloth system 1''', two (or more) support assemblies 3''' may be attached to a single drop cloth 2''' with the edge supports 9''', 10''' of each support assembly extending along the same opposite edges 11''', 12''' of the drop cloth in end-to-end relation to each other with a slight space or gap 40 between adjacent ends of the edge supports as schematically shown in FIG. 10. This has the advantage that a single drop cloth system can be used to protect a larger surface area than is protectable with a smaller drop cloth system including only one support assembly. When the job is done, the drop cloth 2''' of the larger drop cloth system 1''' can easily be folded between the adjacent ends of the edge supports 9''', 10''' of the support assemblies 3''' with any soiled portions of the drop cloths facing each other and then rolled up into a tube and secured with straps or ties for ease of storage and transportation when not in use as before.

Although the invention has been shown and described with respect to certain embodiments, it is obvious that equivalent alterations and modifications will occur to others skilled in the art upon the reading and understanding of the specification. In particular, with regard to the various functions performed by the above-described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiments of the invention. In addition, while a particular feature of the invention may have been disclosed with respect to only one embodiment, such feature may be combined with one or more other features as may be desired and advantageous for any given or particular application.

What is claimed is:

1. A drop cloth system for use in protecting a surface area of a floor or other surface area against splatter during painting or otherwise coating an other surface, comprising a drop cloth and a support assembly for maintaining the drop cloth spread out on the surface area to be protected, the drop cloth having opposite end edges and opposite side edges, and the support assembly comprising stiff edge supports extending along substantially the entire length of two of the opposite edges of the drop cloth for preventing folding of the opposite edges along which the edge supports extend, and at least one spring strip means extending from one of the edge supports to the other edge support, the spring strip means being windable when extended between the edge supports to permit the drop cloth to be rolled up from one of the opposite edges along which the edge supports extend with the spring strip means wound up inside the rolled up drop cloth, and when the rolled up drop cloth is released, the spring strip means unwinds to unroll the drop cloth and the spring strip means is substantially straight when unwound to maintain the drop cloth substantially spread out on the surface area to be protected.

2. The drop cloth system of claim 1 wherein the support assembly is removably connected to the drop cloth to permit the support assembly to be removed for cleaning or replacement of the drop cloth.

3. The drop cloth system of claim 2 wherein opposite ends of the opposite edges along which the edge supports extend include pockets in which opposite ends of the edge supports are removably received.

4. The drop cloth system of claim 2 wherein opposite side edges of a strip of fabric material are secured to one side of the drop cloth in a direction extending from the one edge support to the other edge support provide a channel therebetween in which the spring strip means is received.

5. The drop cloth system of claim 4 wherein one side edge of the strip of fabric material is fixedly attached to the one side of the drop cloth and an other side edge of the strip of fabric material is detachable from the drop cloth for ease of removal of the spring strip means from the channel formed by the strip of fabric material.

6. The drop cloth system of claim 1 wherein opposite ends of the spring strip means are detachably connected to the edge supports.

7. The drop cloth system of claim 1 further comprising straps or ties for maintaining the drop cloth and the spring strip means rolled up together for easy storage and transportation of the drop cloth system when not in use.

8. The drop cloth system of claim 7 wherein the straps or ties include hook-and-loop fasteners for releasably securing the straps or ties around the drop cloth and the spring strip means when rolled up together.

9. The drop cloth system of claim 1 wherein the spring strip means comprises a length of spring steel having a curved cross section.

10. The drop cloth system of claim 1 wherein the spring strip means comprises any one of a coil wire spring, a fiberglass reinforced plastic extrusion, a spring steel or plastic ribbon surrounded by a plastic cover, and spring steel wires or plastic wires embedded or contained in a plastic cover.

11. The drop cloth system of claim 1 wherein the drop cloth is comprised of multiple layers including a moisture-repellent bottom layer, a moisture-absorbent middle layer, and a top layer that allows moisture to pass therethrough for absorption by the middle layer.

12. The drop cloth system of claim 1 wherein the edge supports are rigid strips attached to the opposite edges of the drop cloth along which the edge supports extend.

13. The drop cloth system of claim 1 which includes at least two support assemblies each having respective stiff edge supports extending along the same opposite edges of the drop cloth in end-to-end relation to each other with spacing between adjacent ends of the respective edge supports to permit the drop cloth to be folded between the respective edge supports with any soiled portions of the drop cloth facing each other and then rolled into a tube, and at least one spring strip means extending between each of the respective edge supports that are wound up inside the rolled up drop cloth.

14. A method of protecting a surface area of a floor or other surface area against splatter during painting or otherwise coating an other surface using the drop cloth system of claim 1, comprising the steps of rolling the drop cloth up from one of the opposite edges along which the edge supports extend with the spring strip means wound up inside the rolled up drop cloth, securing the drop cloth in the rolled up condition using straps or ties, placing the rolled up drop cloth system on the surface area to be protected, and releasing the straps or ties to allow the spring strip means to unwind to unroll the drop cloth and the spring strip means is substantially straight when unwound to maintain the drop cloth substantially spread out on the surface area to be protected.

15. The method of claim 14 further comprising the step of moving the drop cloth system from one location to another on the surface area to be protected while the drop cloth is maintained spread out by the edge supports and the unwound spring strip means.

16. The method of claim 14 further comprising the steps of placing a second rolled up drop cloth system on the surface area to be protected, and releasing the straps or ties of the second drop cloth system to allow the spring strip means of the second drop cloth system to unwind to unroll the second drop cloth and the spring strip means is substantially straight when unwound to is maintain the drop cloth substantially spread out on the surface area to be protected.

17. The system of claim 16 further comprising the steps of placing the drop cloth systems on the surface area to be protected with one of the drop cloth systems trailing an other of the drop cloth systems, and moving the trailing drop cloth system ahead of the other drop cloth system during painting or coating a wall or the like as the painting or coating progresses along the wall.

18. The method of claim 16 further comprising the step of placing the drop cloths on top of each other with any soiled portions of the drop cloths facing each other, rolling both drop cloths up together into a tube, and maintaining both drop cloths rolled up together using straps or ties for easy storage and transportation when not in use.

19. The method of claim 14 wherein at least two support assemblies are attached to the drop cloth with the edge supports of each support assembly extending along the same opposite edges of the drop cloth in end-to-end relation to each other with a space or gap between adjacent ends of the edge supports, further comprising the steps of folding the drop cloth between the adjacent ends of the edge supports with any soiled portions of the drop cloth facing each other, rolling the drop cloth up into a tube, and maintaining the drop cloth rolled up using straps or ties for easy storage and transportation when not in use.

* * * * *

UNITED STATES PATENT AND TRADEMARK OFFICE

CERTIFICATE OF CORRECTION

PATENT NO. : 7,691,465 B2
APPLICATION NO. : 11/848530
DATED : April 6, 2010
INVENTOR(S) : Richard K. Bukovitz et al.

It is certified that error appears in the above-identified patent and that said Letters Patent is hereby corrected as shown below:

Column 5,
Line 57, insert --to-- after "support".

Column 6,
Line 59, delete "is".

Signed and Sealed this

Twenty-second Day of June, 2010

David J. Kappos

David J. Kappos
*Director of the United States Patent and Trademark Office*